US005566667A

United States Patent [19]

Cox

[11] Patent Number: 5,566,667

[45] Date of Patent: Oct. 22, 1996

[54] SMOKE FILTER WITH AUTOMATED CLOGGING PREVENTION FOR OPEN-HEARTH FIREPLACES

[76] Inventor: Jennifer Cox, 7 Dromara La., Ladue, Mo. 63124

[21] Appl. No.: 505,972

[22] Filed: Jul. 24, 1995

[51] Int. Cl.[6] ..... F24B 1/191

[52] U.S. Cl. ..... 126/507; 126/307 R; 126/539; 110/217

[58] Field of Search ..... 110/216, 217, 110/119; 126/307 R, 507, 512, 539

[56] References Cited

U.S. PATENT DOCUMENTS

| | | | |
|---|---|---|---|
| 926,266 | 6/1909 | Livesey | 126/539 |
| 1,752,007 | 3/1930 | Kline | 126/507 |
| 2,296,354 | 9/1942 | Kraus | 126/507 |
| 2,703,566 | 3/1955 | Fogel et al. | 126/507 |
| 3,049,113 | 8/1962 | Northwood et al. | 126/120 |
| 3,409,002 | 11/1968 | Vackar | 126/507 |
| 3,608,278 | 9/1971 | Greenspan | 110/217 |
| 3,706,182 | 12/1972 | Sargent | 55/124 |
| 4,156,418 | 5/1979 | Berg | 126/120 |
| 4,470,834 | 9/1984 | Fasanaro et al. | 55/501 |
| 4,485,797 | 12/1984 | D'Alessandro | 126/1 A |
| 4,649,808 | 3/1987 | Ward et al. | 98/59 |
| 4,673,658 | 6/1987 | Gadkaree et al. | 501/89 |
| 4,675,029 | 6/1987 | Norman et al. | 110/216 |
| 4,909,161 | 3/1990 | Germain | 110/216 |

*Primary Examiner*—Edward K. Look
*Assistant Examiner*—Michael S. Lee
*Attorney, Agent, or Firm*—Patrick D. Kelly

[57] ABSTRACT

This invention discloses a filter-and-fan assembly that can be installed into new fireplaces or retrofitted into existing fireplaces, for filtering dust and smoke out of the hot exhaust gases that are created when wood is burned in fireplaces. This filter assembly is provided with a mechanism that can move the filter out of the flue channel (i.e., the chimney or other exhaust outlet) if the filter becomes clogged by creosote and/or smoke particles. If desired, the mechanism that moves the filter out of the flue path can be automated under the control of a device such as an electronic smoke detector mounted in front of the fireplace, above the fireplace opening. Alternately, a thin filter-paper type of filtering element can be continuously scrolled through the flue channel. A rotating fan blade can be provided directly above the filter element, to ensure that exhaust gases are actively drawn up through the filter. These means for avoiding blockage or hindrance of the flue channel can overcome a major obstacle that, until now, has completely blocked the development and adoption of smoke filters for conventional open-hearth fireplaces. This invention also discloses a convenient and clean method of opening and closing a fireplace damper without having to reach into a sooty fireplace, by inserting a solid damper plate (rather than a filter element) into a filter support bracket in a flue channel.

10 Claims, 4 Drawing Sheets

SMOKE FILTER WITH AUTOMATED CLOGGING PREVENTION FOR OPEN-HEARTH FIREPLACES

BACKGROUND OF THE INVENTION

This invention is in the field of mechanical devices, and relates to filters for reducing pollution from conventional wood-burning fireplaces.

A number of communities have adopted ordinances which are intended to limit the amount of smoke or other pollutants emitted by wood-burning fireplaces. Such ordinances are especially common in ski resort areas and other communities in mountainous areas which have abundant supplies of wood nearby, and in which deliveries of natural gas or fuel oil would be especially expensive, and in various regions where large populations, automobiles, and other factors combine to pose chronic air pollution problems.

However, since it is difficult to limit the amount of smoke emitted by a residential fireplace once it has been built, most such ordinances take the form of zoning-type controls that limit the number of fireplaces which can be built in new developments, and do not make any effort to reduce the amount of smoke emitted by existing fireplaces.

For a number of reasons, a better approach would be to reduce the amount of smoke, dust, and other pollutants emitted by the fireplaces, during use.

Various types of filters have been proposed for the flue channels (this term includes brick chimneys, metallic exhaust pipes, or other fireplace exhaust outlets) of certain types of fireplace assemblies. However, to the best of the Applicant's knowledge after a diligent search of the prior art, the only such filters that have been proposed to date are designed as components of large, complex assemblies which comprise complete fireplaces. Examples include the filter assemblies shown in the fireplaces described in U.S. Pat. Nos. 4,279,239 (Blum 1981) and 4,557,687 (Schirneker 1985). Both of these proposed types of filters are contained within large hood-type assemblies that appear to extend from the top of a fireplace opening, all the way up to roughly the height of a ceiling; therefore, these filters cannot be retrofitted into existing fireplaces. In addition, it appears that none of those proposed systems have actually been manufactured and are available for purchase by the public.

Various filters and catalytic converters are used with enclosed wood-burning stoves, and factory smokestacks; examples are described in U.S. Pat. Nos. 4,286,528 (Willard 1981), 4,470,834 (Fasanaro et al, 1984), and 3,706,182 (Sargent 1972). However, as used herein, the term "fireplace" does not include wood-burning stoves which provide a complete enclosure for burning wood, or to incinerators, factory smokestacks, or other such burning chambers. Instead, as used herein, the term "fireplace" is limited to conventional open-hearth fireplaces that are enclosed in front only by mesh-type screens or glass doors, as commonly used in single-family residences, primarily for burning wood (although other fuels such as petroleum-based starter logs, rolled-up newspapers, etc. are often used), and which radiate heat into a room directly from flames that are visible from outside the fireplace.

Although it might appear to be obvious to provide smoke-and-dust filters in the flues of conventional fireplaces, not a single such unit is commercially available, and discussions with several fireplace manufacturers' representatives have indicated several reasons why such units are not being manufactured and sold.

The most important factor involves a fear that if a filter element becomes clogged or otherwise blocked, even if only partially blocked, then air flow out the flue channel will be impeded, and the smoke and hot exhaust gases will exit the front opening and go directly into the room, causing major annoyance and a possible fire hazard. This fear is greatly aggravated by the fact that the hot gases that rise from burning wood contain unburned organic molecules that can condense on any surface that is cooler than the hot exhaust gas, thereby forming creosote, a sticky residue that both (1) greatly increases the danger of clogging a fireplace filter, and (2) poses a fire hazard in its own right, since creosote if flammable if heated sufficiently. Furthermore, if a fireplace filter does become clogged, and smoke begins pouring out of the front opening of the fireplace into the room, the intense heat generated by the fire would make it extremely difficult to reach and manipulate the filter, to replace or remove the filter element.

Another relevant factor concerns air flow and heat conduction in fireplaces. Glass fireplace doors are designed so that they will not be air-tight; they are designed to allow a certain amount of air to pass through the cracks between the doors, to help keep the glass in the doors from becoming overheated. If a filter were to impede the flow of hot exhaust gases out of the flue channel, these glass doors might be jeopardized and might be heated to the point of breaking or warping.

The subject invention discloses a device and method for resolving and overcoming those concerns, and provides a fireplace filter that can operate in a safe and effective manner. It is particularly suited for use in ski resort towns and other areas that restrict or prohibit the installation of new fireplaces.

Accordingly, one object of this invention is to provide a filter-and-fan assembly which can be installed into new fireplaces or retrofitted into existing fireplaces, for filtering dust and smoke (and possibly other agents, such as creosote-generating organic compounds) out of the hot exhaust gases that are created when wood is burned in fireplaces, without creating a major risk of clogging that would create a smoke or fire hazard.

Another object of this invention is to provide a convenient, practical, and relatively inexpensive means for reducing the amount of smoke that is emitted by residential fireplaces in communities that have high numbers of such fireplaces.

These and other objects of the invention will become clear through the following description and drawings.

SUMMARY OF THE INVENTION

This invention discloses a filter-and-fan assembly that can be installed into new fireplaces or retrofitted into existing fireplaces, for filtering dust and smoke out of the hot exhaust gases that are created when wood is burned in fireplaces. This filter assembly is provided with a mechanism that can move the filter out of the flue channel (i.e., the chimney or other exhaust outlet) if the filter becomes clogged by creosote and/or smoke particles. If desired, the mechanism that moves the filter out of the flue path can be automated under the control of a monitoring device, such as an electronic smoke detector mounted in front of the fireplace above the fireplace opening. Alternately, a long, thin filter element can be continuously scrolled through a flue channel. These means for avoiding blockage or hindrance of the flue channel can overcome a major obstacle that, until now, has completely blocked the development and adoption of smoke filters for conventional open-hearth fireplaces.

DESCRIPTION OF THE PREFERRED EMBODIMENTS

Figure 1:
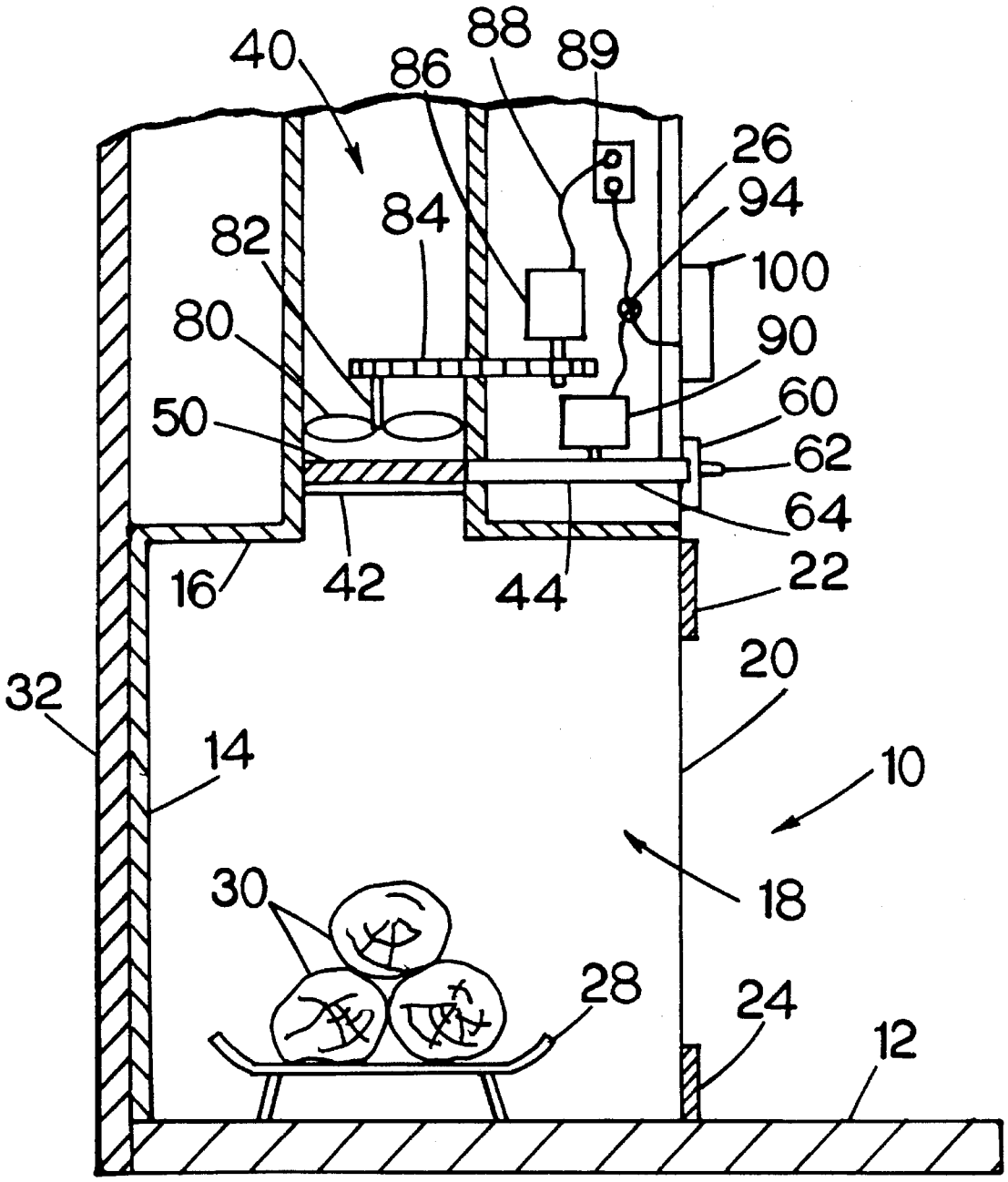
FIG. 1 is a cross-sectional side view showing a smoke filter and fan blade positioned in the flue channel of a fireplace, and an ejector motor controlled by a smoke detector mounted above the fireplace opening.

Referring to the drawings more particularly by reference numbers, number 10 in FIG. 1 refers to an open-hearth fireplace which is enclosed on all sides except the front by a hearth floor 12, a back wall 14, a firebox ceiling 16, and side walls 18, all of which are made of or covered by highly fire-resistant materials such as suitable types of concrete or brick. Front opening 20 is flanked above and below by support tracks 22 and 24, which allow a metallic mesh screen and glass doors (not shown) to be opened or closed. A decorative facade 26 made of brick, stone, metal, glass, or other fire-resistant material is located above the front opening 20. A log stand 28 is used to support logs 30.

If the fireplace is positioned against an external wall, the fire-resistant back wall 14 may be covered by an exterior layer of siding, brick, or wood 32; alternately, if the fireplace and chimney are made of brick or other suitable material, the fire-resistant back wall 14 may directly provide the exposed exterior surface. In addition, a filter system as described herein can also be used in fireplaces that are positioned away from any walls and designed to emit heat into a room from all sides, or in fireplaces that are built into internal walls and designed to heat two different rooms. Fireplace 10 may comprise a partially pre-fabricated unit which is purchased as a subassembly and then installed into a house or room; alternately, the hearth, walls, and other necessary components can be constructed entirely by bricklayers or carpenters. All of the foregoing components and options are conventional and are widely known and used in the prior art, and they may be modified in various ways as known to those skilled in the art.

Figure 2:
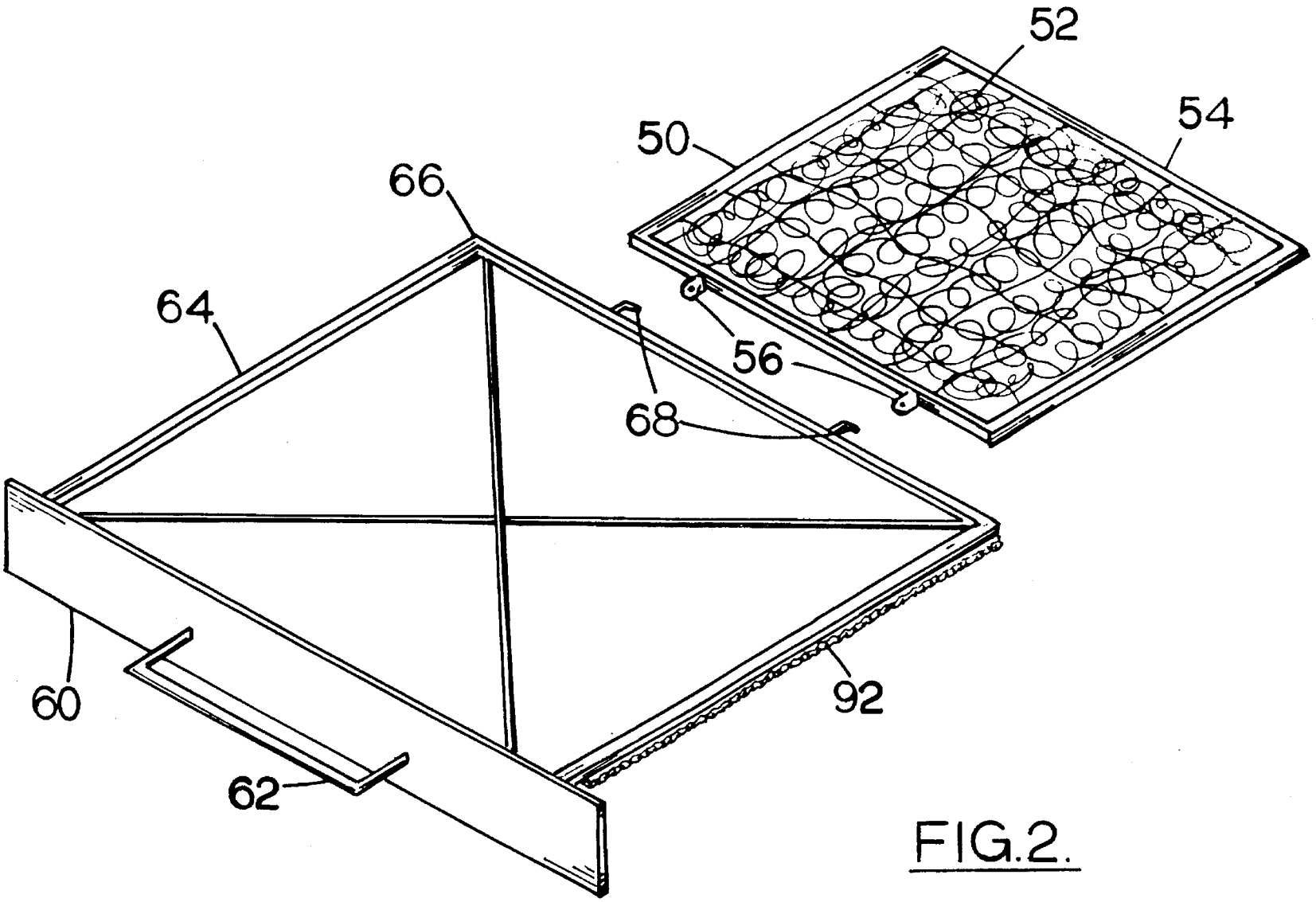
FIG. 2 depicts an access door panel and spacer bracket, which can be coupled to a filter.

The flue channel 40 may be formed by a brick chimney, a metallic pipe or duct, or any other suitable outlet for hot exhaust gases emitted by a fire in the fireplace. Positioned within flue channel 40 is a filter 50, which comprises a porous filter element 52 surrounded around its periphery by a frame 54 as shown in FIG. 2. When in use during a fire, filter 50 is supported and held in place in the fireplace flue channel 40 by a filter support bracket 42. The support bracket 42 is permanently affixed inside the flue channel 40, and remains stationary while new filters are inserted and removed whenever necessary. Access to the support bracket 42 is provided by means of access channel 44, which opens in the front of the fireplace. Before a fire is started in the fireplace, a clean filter 50 is inserted into support bracket 42 via access channel 44. This positions the filter 50 directly in the path of the hot exhaust gases that are exiting the fireplace through flue channel 40.

The front opening of access channel 44 is normally covered and closed by a door panel 60, which has a handle 62 or other suitable means for gripping and opening the door panel 60. In one preferred embodiment, shown in FIG. 2, the back side of door panel 60 is coupled directly to a spacer bracket 64. In an alternate embodiment, the door panel 60 can be purely decorative, and can be secured to the fireplace front by any suitable means, such as hinges along the top or bottom or resilient spring-type clip fittings, while the spacer bracket 64 can be independent.

The spacer bracket 64 has a distal end 66 fitted with coupling means that can be coupled to filter 50. This filter coupling can comprise any suitable mechanism that will sustain sufficient tension to allow a filter to be pulled out after use. For example, metal pins 68 on spacer bracket 64 can be inserted into accommodating slots, eyelets, or lugs 56 on the side of filter frame 54.

The spacer bracket 64 allows the filter 50 to be pushed all the way into the support bracket 42. When in use, the filter 50 will filter out and remove smoke and dust particles and creosote components from the hot exhaust gases that rise from the fire, thereby reducing the amount of air pollution emitted by the fireplace.

After a fire has died or cooled off to the point where it is no longer emitting any substantial smoke, filter element 50 (which is now considered "dirty" or "used") is removed from the flue channel 40 by pulling out the access door panel 60. If the filter 50 has been properly coupled to the spacer bracket 64, then the filter element will also be pulled out as the access door panel 60 and support bracket 64 are pulled out of the access channel 44. The used/dirty filter 50 is uncoupled from the spacer bracket 64 and replaced by a clean filter, to prepare for the next fire.

As shown in FIG. 1, a fan blade 80 is positioned above filter 50, to draw smoke and exhaust gases up through the filter and to prevent the buildup of pressure in the burning zone, beneath the filter. The fan blade 80 is mounted on a rotating axle 82 which is supported by an open-framed mounting bracket that does not significantly impede the flow of exhaust gases up through the flue channel.

Axle 82 can be coupled directly to an electric motor if desired, if the motor is properly designed and provided with adequate protection against hot exhaust gases, smoke, and creosote. Alternately, axle 82 can be fitted with a sprocket or gear that can be driven by a chain or belt 84 (or other suitable mechanical means) as shown in FIG. 1. This allows a less expensive electric fan motor 86 to be placed in a sheltered location that is not located in the path of flue channel 40. This arrangement can minimize exposure of the fan motor 86 to smoke, creosote, and hot exhaust gases, which might foul the motor or require a substantially more expensive design. The fan motor can receive electric power through a standard electrical cord 88 that passes through a side wall (if desired) and is wired or plugged into an electrical power outlet 89. A power switch should be provided somewhere in the circuit that is easily accessible, to allow users to turn the fan motor 86 on and off at will.

One of the important features of this invention is a means for easily removing filter 50 from the path of flue channel 40, in case the filter becomes clogged or dirty to a point where flow through the filter is impeded and smoke begins exiting the fireplace out of the front opening, in an undesirable and potentially dangerous path. This can be done by mounting a smoke detector 100 in front of the fireplace, either directly on or above the front facade 26 (as shown in FIG. 1) or at any other suitable location, such as attached to a mounting bracket hanging from a ceiling location directly above or near the fireplace front.

In a manual method of ejecting a clogged or dirty filter, the smoke detector 100 will sound an alarm if smoke begins exiting the fireplace through the front opening. If that happens, anyone who is at home can simply pull out the filter, manually, by removing the access door panel 60 and then pulling out the spacer bracket 64 and the filter 50. This method can be reliable in the vast majority of cases, since someone should be at home whenever a fire is going in a fireplace while the glass doors are open. If the users need to leave the house for any reason while a fire is still burning, they can simply pull out the filter before they leave, leaving the flue channel open.

Alternately, an automated system for ejecting a filter can be provided if desired, as shown in FIG. 1. In this approach, a filter ejector motor 90 is positioned in a sheltered location, hidden behind the front facade 26 but outside of the flue channel 40, near spacer bracket 64. The axle of this motor 90 is fitted with a rubberized pinch roller, a pinion gear or sprocket, or any other suitable drive mechanism which can interact with a rail, gear rack, chain, or other accommodating device that is mounted on or coupled to the spacer bracket 64 (for example, a gear rack 92 is shown mounted on the side of spacer bracket 64 in FIG. 2, for use with a rack-and-pinion drive system). If the smoke detector goes off, indicating that the filter 50 has become too clogged or dirty to allow proper exhaust flow, then an electronic signal generated by the smoke detector 100 will close a switch 94, thereby activating the filter ejector motor 90. The filter ejector motor will drive the filter out of the flue channel, thereby allowing free flow of exhaust gases up the chimney. If desired, the spacer bracket can be equipped with a cutoff switch, to open the electric circuit and turn off the ejector motor 90 after the filter has been pulled out of the flue channel 40. The filter can be ejected partway through the access door, which will render it visible to anyone in the room, or it can be moved into an alternate holding position inside the fireplace assembly.

This system can also be used to provide a chimney damper, to completely close off the flue channel whenever the fireplace is not in use. This is done by simply inserting a solid plate into the flue channel, in place of a filter, until the plate settles into support bracket 42 (when used for this purpose, item 42 in FIG. 1 will serve as a damper support bracket, and item 50 will be a solid damper plate rather than a porous filter element). This provides an easy, clean, and convenient way of opening and closing the damper, which can be done by anyone standing in front of the fireplace, and it eliminates the need for getting down on the knees, buttocks, or backside and then having to reach up inside a dark, dirty, sooty fireplace whenever the damper needs to be opened or closed.

Figure 3:
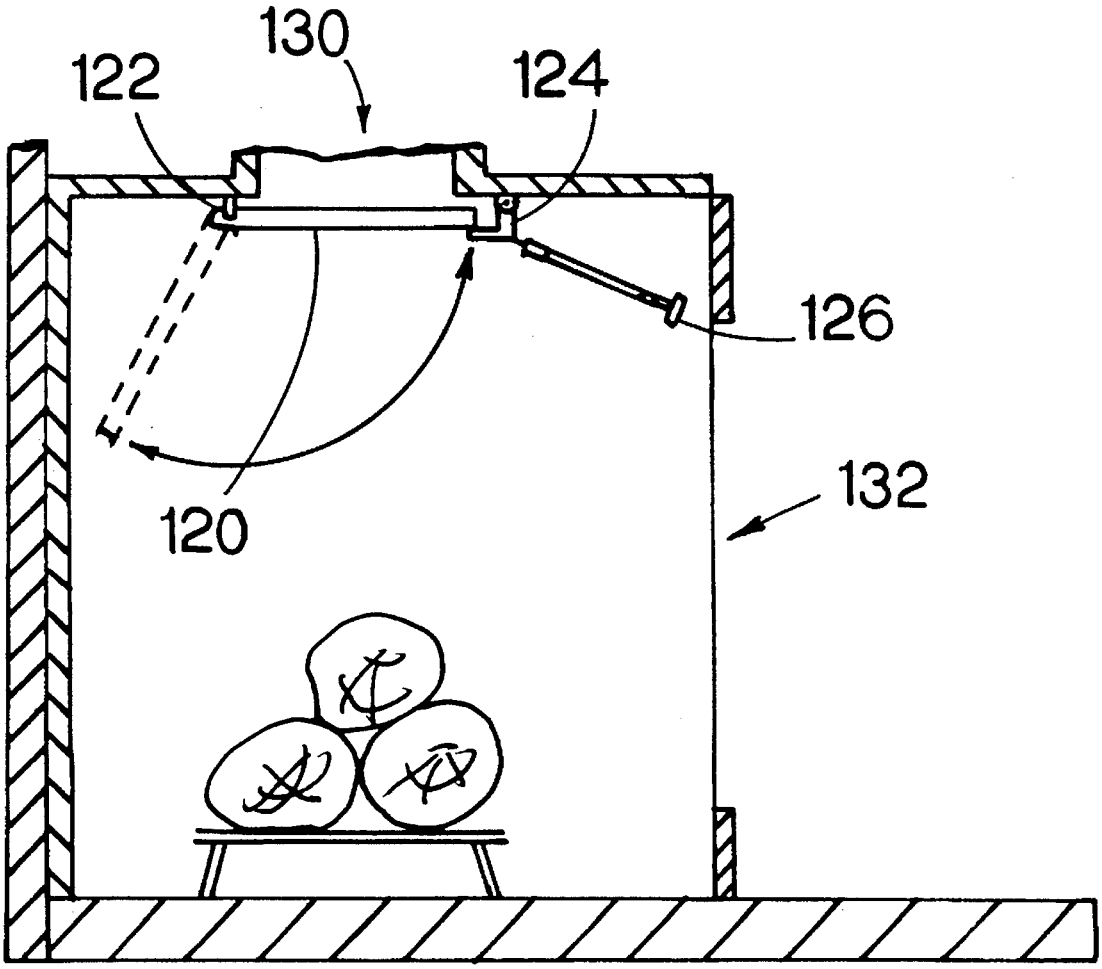
FIG. 3 is a cutaway side view showing a filter element that can be inserted into a support bracket through the front opening of a fireplace, to eliminate the need for a special access door for the filter, and which is mounted in a hinged support bracket held in place by a latch that can be easily disengaged if a fire is going.

Various other means can be used, if desired, to emplace a smoke filter in a fireplace flue in a manner that will allow the filter to be ejected or otherwise removed from the flue channel, while a fire is still burning, if the filter becomes too clogged or dirty to allow proper air flow through it. For example, as shown in FIG. 3, a filter element can be secured inside a support bracket 120 which rotates around a spring-loaded hinge 122 mounted on the ceiling of the firebox near the mouth of the flue channel 130. For use, the support bracket and filter element can be rotated and swung up into position until the front edge of the support bracket 120 engages a spring-loaded latching mechanism 124 mounted in front of the flue channel 130. The latching mechanism 124 can be disengaged (thereby allowing the spring-loaded support bracket and filter to swing out of the way of the flue channel) either automatically (by means of a motor-operated or solenoid-operated latch actuator), or manually. Manual activation can utilize, for example, a small cable or chain coupled to a handle mounted in any location that is accessible by hand (such as on the front of the fireplace) or positioned inside the firebox and accessible to manipulation by a poker, tongs, or other log-handling device that can be inserted into the firebox while a fire is burning, to pull the handle.

It should be noted that FIG. 3 depicts means for emplacing a filter element in flue channel 130, and for removing the filter from the flue channel in case the filter element becomes clogged, which does not require a special access door mounted on the front of the fireplace. Instead of a special access door, the normal fireplace opening 132 can be used to access the filter element.

SCROLLING FILTER DEVICES

Figure 4:
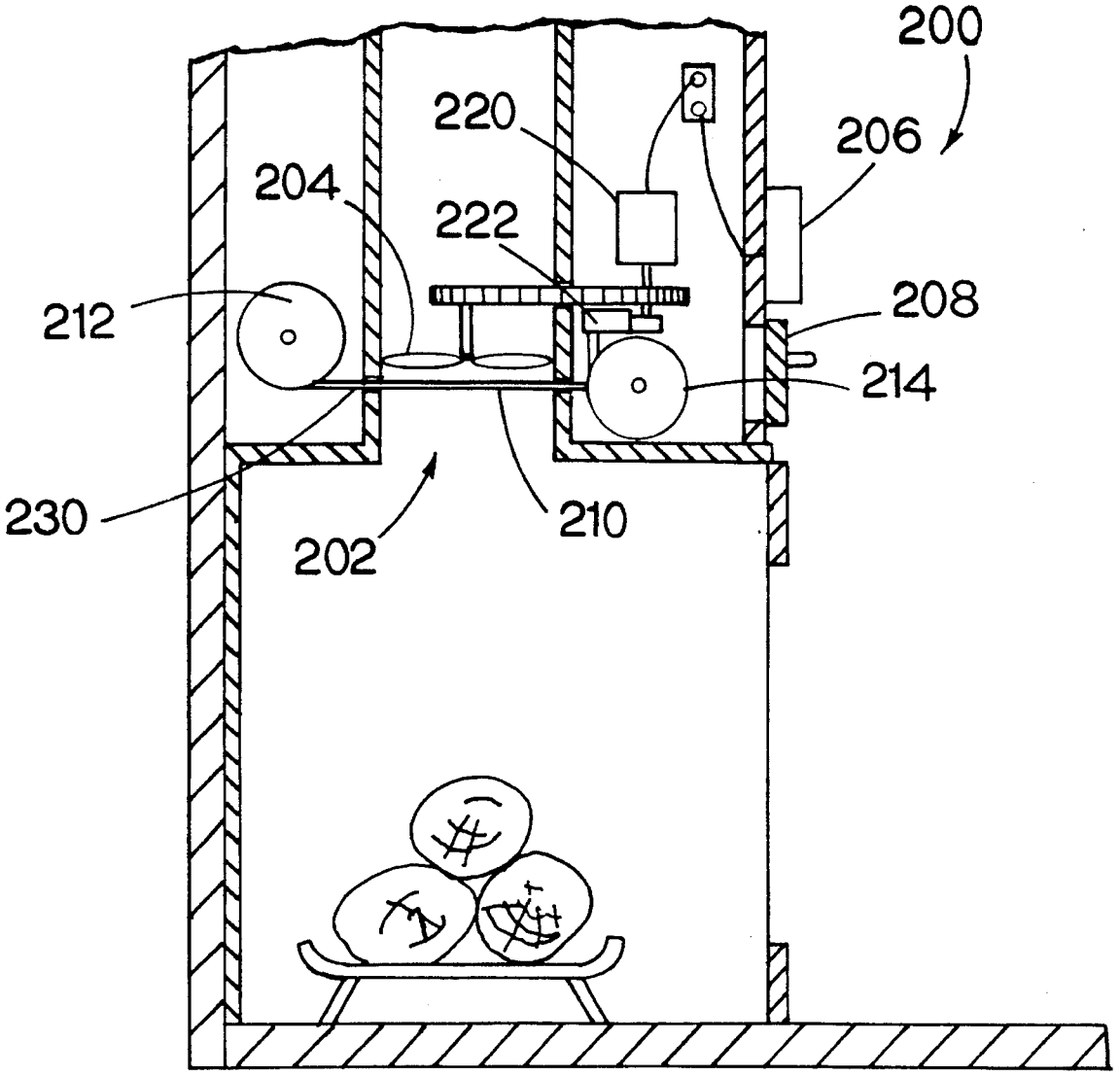
FIG. 4 is a cutaway side view showing a relatively thin paper-type filter element mounted in a scrolling device, allowing the filter to be continuously pulled through the smoke-gathering zone.

In another alternate preferred embodiment in a fireplace assembly 200, shown in FIG. 4, a long segment of a relatively thin filter element 210, made of a suitable heat-resistant material comparable to filter paper, is mounted on or in a supply device 212, such as supply reel 212. The filter element 210 passes across the throat of the fireplace flue 202, constrained so that it remains located in a preferred track or position by tension or other suitable mechanical means, and is collected on a take-up reel 214. When in use while a fire is burning, the same motor 220 which drives the fan 204 also works, through a gear reducer 222, to slowly rotate the take-up reel 214. This causes the take-up reel 214 to slowly pull the filter element 210 through the soot-gathering zone in the throat of the fireplace flue 202, so that any particular portion of the filter element 210 will remain in the soot-gathering zone for only a limited period of time. This type of continuous scrolling method and device will continuously pull fresh filter paper into the soot-gathering zone, and will prevent the filter from becoming clogged.

The "dwell time" (i.e., the amount of time that a particular point on a filter element should remain within the soot-gathering zone in the throat of a fireplace flue) will depend on various factors, including the thickness and pore size of the filter paper being used, and in some cases the nature of the wood being burned. Accordingly, the preferred "dwell time" can be optimized based on routine experimentation for any selected type of thin filter elements, and can be controlled by varying the speed of rotation of the takeup reel. In general, is it anticipated that preferred dwell times for most types of filter paper are likely to be in the range of about 2 minutes to about 10 minutes. If desired, variation in takeup speed can be provided manually, by giving a homeowner several speed settings through a switch or knob (this will also allow a homeowner to accommodate the fact that takeup speed will vary as the takeup reel accumulates more filter paper), or automatically, through a relatively simple control circuit.

The positions of the supply and takeup reels shown in FIG. 4 (i.e., with the supply reel behind the flue, and the takeup reel in front of the flue) can be used in a fireplace assembly that extends out from a wall and is provided with a side access panel or other suitable means of access to the reels, so that both reels can be removed and replaced when necessary. In an alternate preferred embodiment, the two reels can be placed on the left and right sides of the flue, so that both reels can be reached and replaced through the front access door 208 or possibly the main front opening of the fireplace.

In another alternate preferred embodiment, the rotating supply reel 212 can be replaced by a device which holds folded and pleated filter paper, comparable to a paper towel dispenser that dispenses pleated paper towels. Regardless of what type of supply device is used, the "tail end" of the filter paper should not be securely attached to it; instead, the tail end should be released so that it can be pulled completely through the flue channel, so that it cannot become clogged when the end of the reel or other supply is reached.

If desired, a continuously scrolling unit as shown in FIG. 4 can be provided with a suitable mechanism (either automated or manual) for intervening in case a malfunction occurs, as evidenced by a substantial quantity of smoke emerging from the front of the fireplace and triggering a smoke detector 206 mounted above the front opening of the fireplace. Suitable intervention could utilize any of several types of mechanisms, such as a manual or automated cutting device (comparable to the small cutting devices used on many telephone fax machines) to cut the filter element at a suitable location, such as location 230, so that it will be pulled out of the flue path by the takeup reel 214. Alternately or additionally, the takeup reel can be provided with a manual crank, accessible through the front door panel 208.

Accordingly, the scrollable filter device described herein, and its various alternate embodiments, can be described as comprising (1) a long segment of thin filter element which is designed and suitable for filtering particulates out of hot exhaust gases that pass through the flue channel when a fire is burning in the fireplace, (2) a supply device which initially contains the segment of filter element, and which is designed to allow the filter element to be pulled through the flue channel, thereby gradually removing the filter element from the supply device, and (3) a takeup device which continuously operates when a fire is burning in the fireplace, to pull the filter element through the flue channel and then out of the flue channel at a speed which prevents any portion of the filter element from becoming clogged to an extent which prevents hot exhaust gases from passing through the flue channel.

GENERAL OPERATION

It is anticipated that a fireplace owner will keep several filters, so that a clean filter will be conveniently available at all times. The porous filter elements described herein can be made of any suitable material that can withstand high temperatures, such as ceramic whiskers, metallic fibers, etc. Such materials are commercially available, and are discussed in various patents and other references such as U.S. Pat. 4,673,658 (Gadkaree et al, 1987) and other patents cited therein. Such filters can be disposable filters, comparable to disposable furnace filters, which can be replaced before each new fire. However, since filters that can withstand very high temperatures will probably be significantly more expensive than, for example, cheap furnace filters, it is anticipated that reusable filters may also be used, and regenerated after each use, by heating them to vaporize and remove creosote components and then spraying them with water to remove dust and particulates), or by soaking or washing them with suitable detergents or solvents that can remove creosote as well as smoke particles. Regeneration of used filters can also be carried out by service companies that specialize in such operations, comparable to dry cleaners.

It is also anticipated that in communities in which new fireplaces are not allowed because of air pollution reasons, transferable rights might be created, in which a homeowner can obtain permission from the local government to build a new fireplace, if he or she will provide it with a filter and also pay to have filter units retrofitted into one or more existing fireplaces, so that no net increase in smoke emissions will be caused by the new fireplace.

Finally, it should also be noted that the filtering devices of this invention can substantially decrease both (1) the need for periodic maintenance and cleaning of fireplace chimneys, and (2) the risk of fires caused by creosote buildup in chimneys that have not been properly cleaned.

Thus, there has been shown and described a new and useful device and method for using fireplace filters to reduce smoke, dust, and other pollutant emissions from fireplaces, in a manner that is safe and convenient and overcomes the danger of clogged filters leading to smoky rooms and fire hazards. Although this invention has been exemplified for purposes of illustration and description by reference to certain specific embodiments, it will be apparent to those skilled in the art that various modifications, alterations, and equivalents of the illustrated examples are possible. Any such changes which derive directly from the teachings herein, and which do not depart from the spirit and scope of the invention, are deemed to be covered by this invention.

I claim:

1. A filtering device for reducing air-polluting particulates emitted by an open-hearth fireplace having a flue channel that carries hot exhaust gases and smoke out of the fireplace, and a front opening covered only by a mesh screen or glass doors, comprising:

a. a filter support bracket positioned in the flue channel;

b. a porous filter element which is designed and suitable for filtering particulates out of hot exhaust gases that pass through the flue channel, when positioned in the filter support bracket while a fire is burning in the fireplace;

c. electronic detecting means for (1) monitoring smoke emissions that emerge from the front opening of the fireplace to determine whether exhaust gas flow through the porous filter element is being substantially impeded by clogging of the porous filter element, and (2) activating an electronic signal if a substantial quantity of smoke emerges from the front opening of the fireplace due to clogging of the porous filter element; and, d. means for moving the porous filter element out of the flue channel while a fire continues to burn in the fireplace, to allow unimpeded flow of hot exhaust gases and smoke through the flue channel, if a substantial quantity of smoke begins to emerge from the front opening of the fireplace.

2. The filtering device of claim 1 wherein the electronic detecting means comprises an electronic smoke detector mounted on a vertical wall in a location above the front opening of the fireplace.

3. The filtering device of claim 1 wherein the electronic detecting means comprises an electronic smoke detector mounted on a ceiling surface in a location above the front opening of the fireplace.

4. The filtering device of claim 1 wherein the electronic signal which is activated if a substantial quantity of smoke begins to emerge from the front opening of the fireplace comprises an audible signal indicating to nearby occupants that the porous filter element needs to be manually removed from the flue channel.

5. The filtering device of claim 1 wherein the electronic signal which is activated if a substantial quantity of smoke begins to emerge from the front opening of the fireplace controls an electromechanical device which automatically moves the porous filter element out of the flue channel.

6. The filtering device of claim 1 wherein the porous filter element is inserted into the filter support bracket via an access channel that is accessible through an opening in the fireplace front.

7. A filtering device for reducing air-polluting particulates emitted by an open-hearth fireplace having a flue channel that carries hot exhaust gases and smoke out of the fireplace, and a front opening covered only by a mesh screen or glass doors, comprising:

a. a long segment of thin filter element which is designed and suitable for filtering particulates out of hot exhaust gases that pass through the flue channel when a fire is burning in the fireplace;

b. a supply device which initially contains the segment of filter element, and which is designed to allow the filter element to be pulled through the flue channel, thereby gradually removing the filter element from the supply device;

c. a takeup device which continuously operates when a fire is burning in the fireplace, to pull the filter element through the flue channel and then out of the flue channel at a speed which prevents any portion of the filter element from becoming clogged to an extent which prevents hot exhaust gases from passing through the flue channel.

8. The filtering device of claim 7 wherein the supply device comprises a rotatable supply reel.

9. The filtering device of claim 7 wherein the takeup device comprises a rotatable takeup reel.

10. A device for conveniently opening and closing a fireplace damper, comprising:

a. a damper support bracket positioned in the flue channel;

b. a damper plate which is properly sized to fit into the damper support bracket;

c. an access channel that is accessible through an opening in the fireplace front, which allows the damper plate to be inserted into the damper support bracket, and subsequently removed from the damper support bracket, without requiring insertion of an operator's hand into the fireplace in a manner that might get the operator's hand sooty or dirty.

* * * * *